United States Patent [19]

Knutson

[11] 4,073,109

[45] Feb. 14, 1978

[54] METHOD AND APPARATUS FOR INSTALLING PANELS IN BUILDING CONSTRUCTION

[75] Inventor: Carlton N. Knutson, Fergus Falls, Minn.

[73] Assignee: Construction Aids, Inc., Fergus Falls, Minn.

[21] Appl. No.: 701,349

[22] Filed: June 30, 1976

[51] Int. Cl.[2] ..... E04B 1/00

[52] U.S. Cl. ..... 52/281; 52/90

[58] Field of Search ..... 52/281, 90, 92, 93, 52/79, 22, 288

[56] References Cited

U.S. PATENT DOCUMENTS

| | | | |
|---|---|---|---|
| 1,924,414 | 8/1933 | Ring | 52/281 |
| 2,027,883 | 1/1936 | Ross | 52/281 X |
| 2,964,148 | 12/1960 | Jacobson | 52/281 |
| 3,308,590 | 3/1967 | Ettore et al. | 52/281 |
| 3,323,264 | 6/1967 | Cross | 52/281 |
| 3,774,362 | 11/1973 | Matuschek et al. | 52/281 |
| 3,962,840 | 6/1976 | Nelsson | 52/281 |

*Primary Examiner*—J. Karl Bell

*Attorney, Agent, or Firm*—Merchant, Gould, Smith, Edell, Welter & Schmidt

[57] ABSTRACT

A new method of building construction especially adapted for use in new buildings having truss rafters, and apparatus for practicing the method. Application of angle strips in locations where plasterboard ceiling panels are intended to intersect plasterboard wall panels enables durable corners to be constructed where inside partitions abut truss rafters.

1 Claim, 6 Drawing Figures

METHOD AND APPARATUS FOR INSTALLING PANELS IN BUILDING CONSTRUCTION

BACKGROUND OF THE INVENTION

This invention relates to the field of building construction, and particularly to a method and means for facilitating and improving the construction of frame buildings which are sheathed internally with panel materials such as plasterboard.

In such construction it has often been necessary, particularly at internal corners of interior walls, to provide strips of lumber in addition to the usual framing joists for the sole purpose of backing up the edges of panels to ensure rigid, enduring corners in the finished walls. The problem has become particularly difficult with the increased popularity of truss rafters. These rafters are designed for the roof load to be carried by the outer walls of the structure, and interior partitions are made slightly shorter to prevent undesirable roof load transfer thereto. The plates of such partitions cannot be fastened to the truss rafters, and this results in a building structure in which perceptible movement must be permitted between the truss rafters and the partitions. Such movement of course has a strong tendency to product cracks in the internal walls of the building, since the plasterboard panels must be supported by the relatively moving parts.

SUMMARY OF THE INVENTION

The present invention proposes a sheet metal angle strip to be applied along an intended line of intersection between two panels of plasterboard and the like. One edge of a first panel is received in the angle and held there by one edge of a second panel at right angles thereto. The second named panel is secured to the wall very near to the angle strip: with this support the securement of the first panel close to the strip may be eliminated, and the small natural flexibility of the panel material between the strip and a suitable remote line of supporting fasteners permits relative movement of the principal structural members without accompanying defacement of the finished wall cover. The same principle is equally usable at other corners to avoid the necessity of cutting and positioning a plurality of backing strips.

Various other objects, advantages, and features of novelty which characterize my invention are pointed out with particularity in the claims annexed hereto and forming a part hereof. However, for a better understanding of the invention, its advantages, and objects attained by its use, reference should be had to the drawing which forms a further part hereof, and to the accompanying descriptive matter, in which there is illustrated and described a preferred embodiment of the invention.

DESCRIPTION OF THE PREFERRED EMBODIMENT

Figure 1:
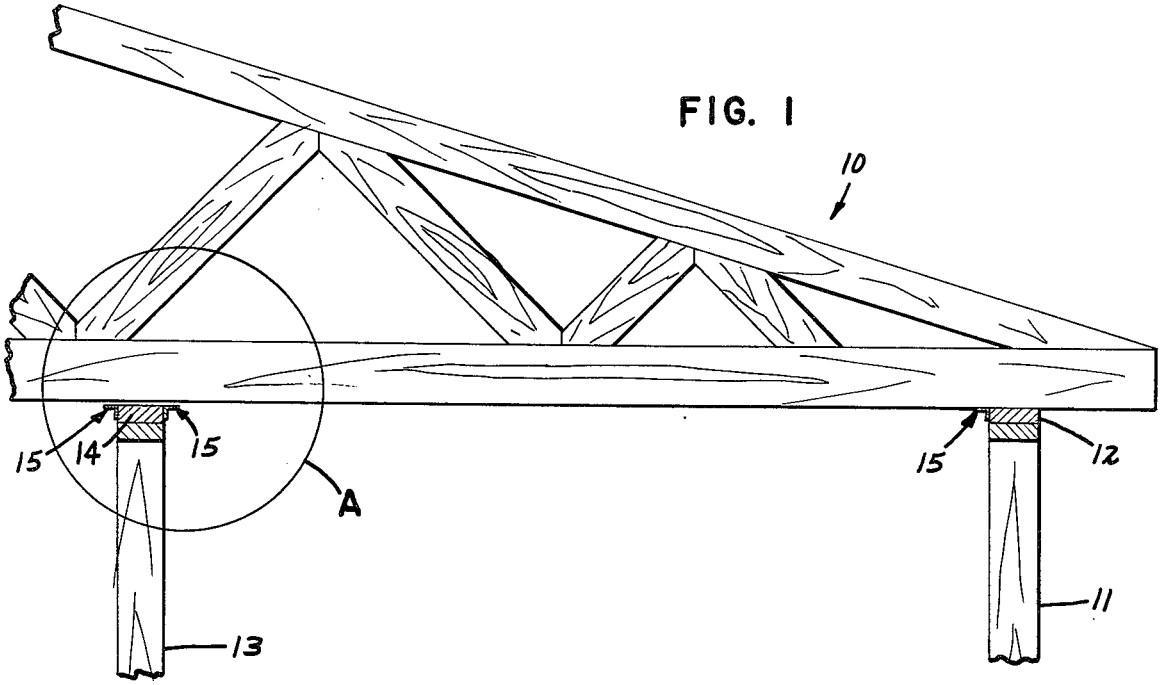
FIG. 1 is a view in vertical section of a building under construction where my invention is being practiced.

Turning now to FIG. 1, a building under construction is seen to include a truss rafter 10 supported on external walls, one of which is shown as 11. The plate of wall 11 is shown at 12. An inner partition 13 extending transversely of rafter 10 is shown to have a plate 14. Partition 13 is slightly shorter than wall 11, leaving slight space for flexure of the rafter, under snow load, for example.

Figure 2:
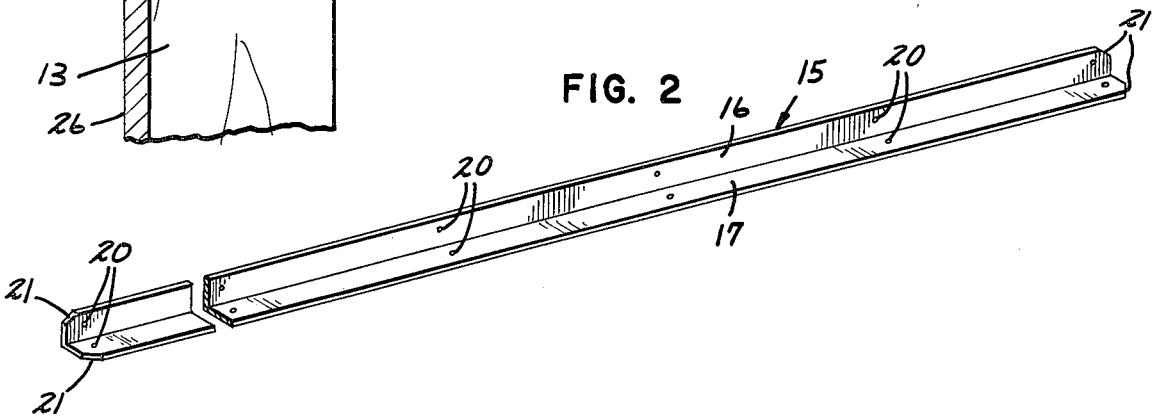
FIG. 2 shows in perspective an angle strip used in the practice of the invention.

Angle strips 15 are secured to edges of plates 12 and 14 flush with the top surfaces thereof. FIG. 2 shows such an angle strip: its legs 16 and 17 are wider than the thickness of panel material to be used with it, and are provided with nailing holes 20 spaced in accordance with the standard spacing of timbers in frame structures, normally 16 inches. For safety, the sharp corners may be cut off as at 21. If it is desired to make the strips of thinner gauge material, the edges may be beaded to stiffen the metal.

Figure 3:
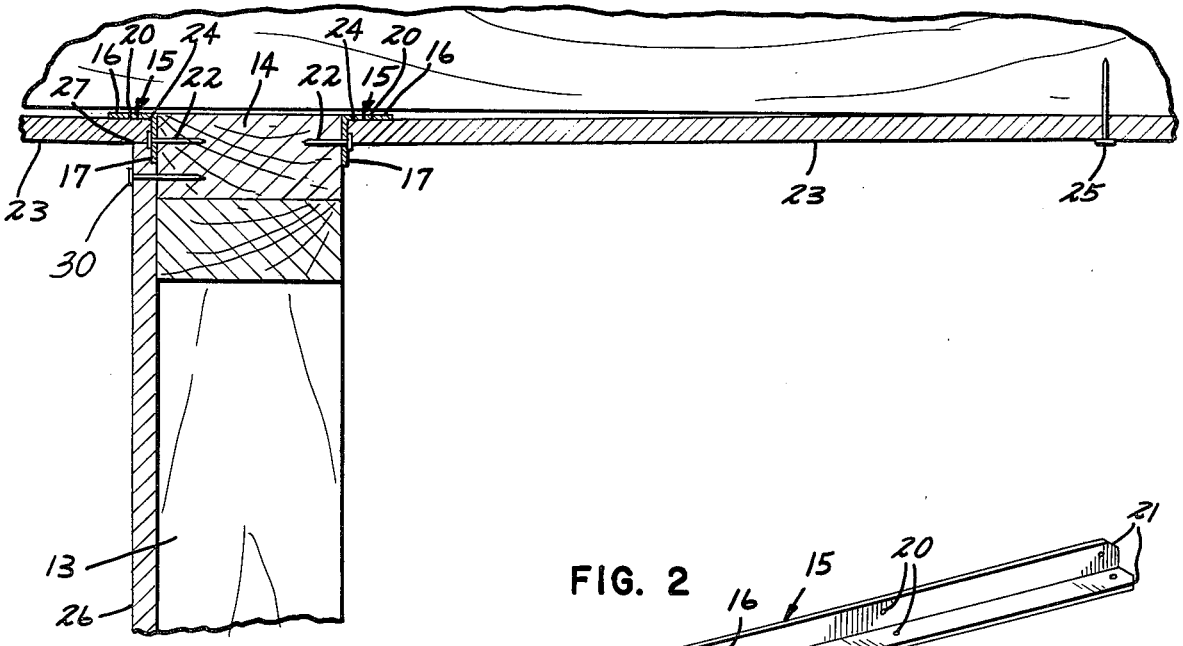
FIG. 3 is a greatly enlarged detail of the portion of FIG. 1 generally indicated within the circle A, showing panel material applied.

FIG. 3 shows that strips 15 are fastened to plate 14 by nails 22. The strips are not secured to rafter 10: for most applications, only the nail holes along one leg of the strip are used. As the next step in construction, a panel 23 of ceiling material such as plasterboard has one edge 24 positioned in the angle of strip 15, and the panel is fastened to the rafters by means such as nails 25, beginning at locations preferably at least a foot away from strip 15. At this stage of construction, the edge 24 itself is unsupported, as is shown to the right of partition 13.

Now a panel 26 of wall material such as plasterboard has one edge 27 positioned in the angle of strip 15 so as to push against the edge of ceiling panel 23, and the wall panel is secured to the partition by nails 30 close to strip 15, and elsewhere as necessary. This construction step is shown to the left of partition 13 in FIG. 2.

It will be apparent that after the construction is completed, the edges of the ceiling portions are positively gripped between the angle strips and the edges of the wall panels in a solid joint that is fixed to partition 13. Any vertical movement of rafter 10 does not affect the partition, and is accompanied by slight flexing of the ceiling panels between fasteners 25 and strips 15, which the elasticity of the panel material is suffficient to permit.

Figure 4:
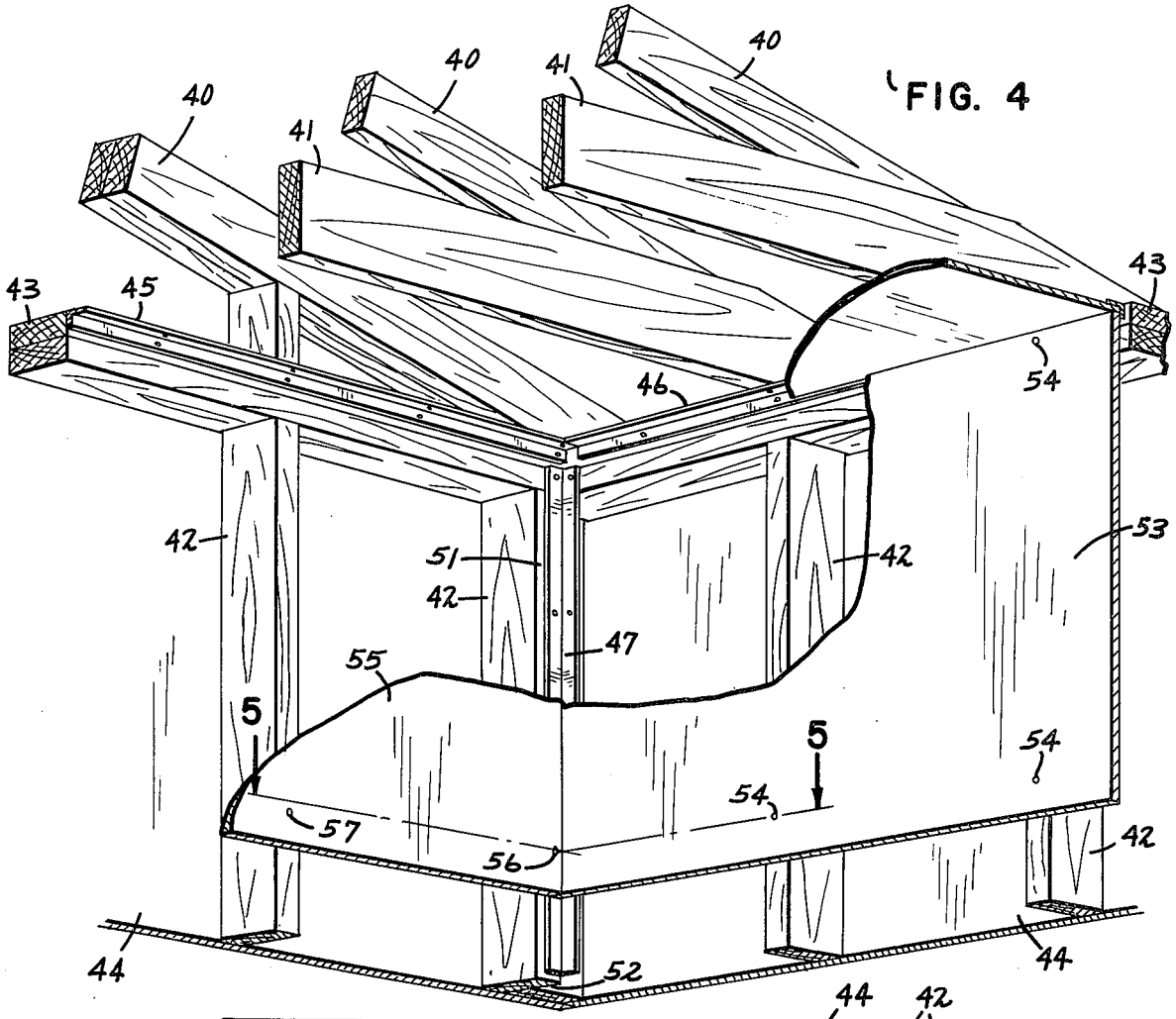
FIG. 4 is an isometric showing of a portion of a building under construction where my invention is being used.

While my invention is most effectively used in the application just described, it may also be used in almost any situation where two panels are to intersect at approximately right angles. FIG. 4 is a fragmentary view looking upward into a corner of a building on a construction. Shown are rafters 40, ceiling joists 41, wall studs 42, wall plates 43, and outside sheathing 44. Angle strips 45, 46 according to my invention are applied along the top edges of the plates, and a single strip 47 is applied vertically to a corner wall stud.

Figure 5:
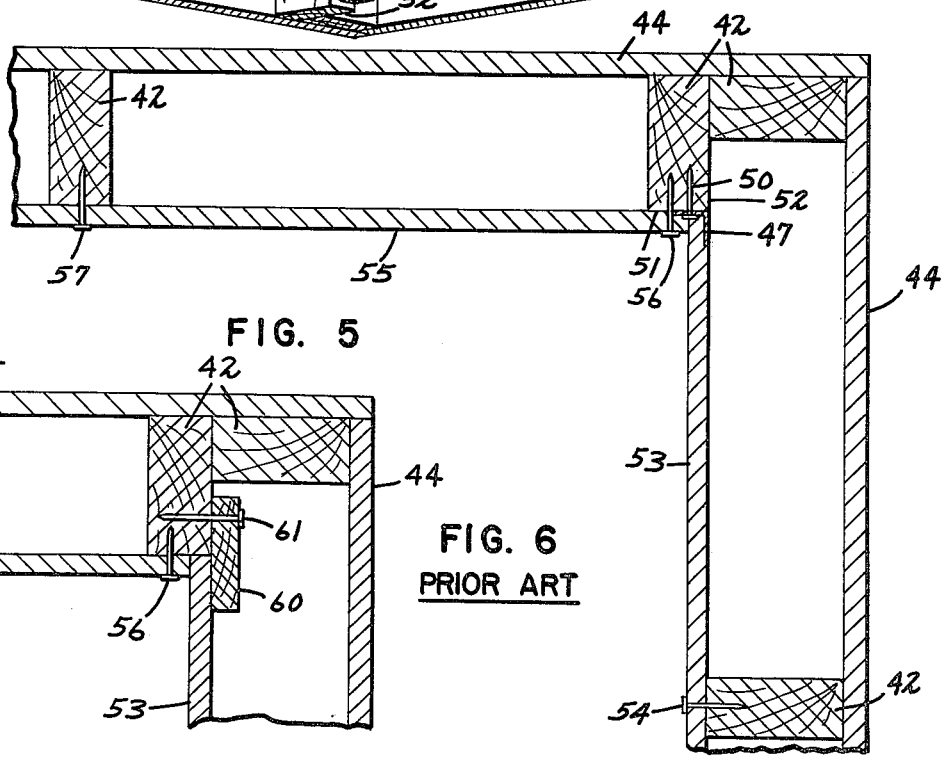
FIG. 5 is an enlarged fragmentary sectional view along the line 5—5 of FIG. 4.

As shown in FIG. 5, strip 47 is secured by nails 50 along one edge 51 of a corner stud 42, flush with the inner face 52 thereof. A first wall panel 53 is now positioned with one edge in the angle of strip 47 and is secured to an adjacent stud and elsewhere by nails 54. A second wall panel 55 is now positioned with an edge bearing against the edge of panel 53 in the angle of strip 47, and is secured by nails 56 close to strip 47 and by the usual other nails 57. Note that all this can be conveniently done after the outer sheathing 44 has been applied.

Figure 6:
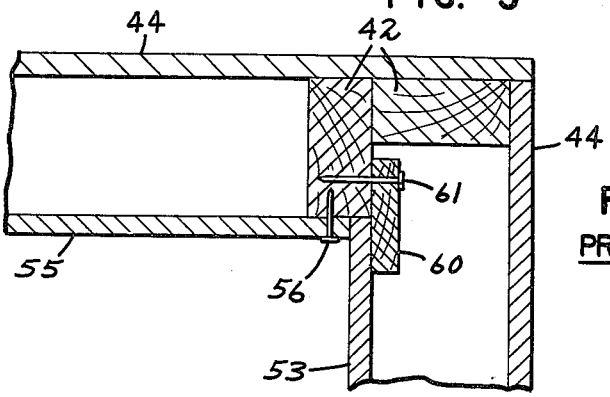
FIG. 6 PRIOR ART
FIG. 6 is a view similar to FIG. 5 showing prior art construction.

By way of contrast, the prior art method for performing the same operation (see FIG. 6) required the cutting of backing strips 60 and their securement in place by nails 61. Not only is this procedure more time consuming, but it must be done before sheathing 44 is applied or the driving of nails 61 becomes a very inconvenient and tedious affair.

The same procedure can be applied to corners between wall and ceiling to avoid the need for cutting and installing wooden nailing strips for backing the ceiling. It must be stressed that while the present invention is a matter of added convenience and expedition in the application shown in FIGS. 4 and 5, it is indispensable and without any adequate substitute for the application shown in FIGS. 1 and 3.

From the foregoing, it will be evident that I have invented a new method and means for use in house construction to ease and expedite the securement of ceiling and wall panels at inside partitions of houses built with truss rafters, and generally in all house construction. My invention avoids the necessity of cutting and installing backing strips, and ensures strong and durable finished corners.

Numerous characteristics and advantages of my invention have been set forth in the foregoing description, together with details of the structure and function of the invention, and the novel features thereof are pointed out in the appended claims. The disclosure, however, is illustrative only, and changes may be made in detail, especially in matters of shape, size, and arrangement of parts, within the principle of the invention, to the full extent indicated by the broad general meaning of the terms in which the appended claims are expressed.

What is claimed is:

1. In a frame structure comprising truss rafters, outer walls upon which the rafters rest and to which thay are fastened, and an inner partition extending transversely to and having a plate near the lower surface of said rafters but not secured thereto, to permit normal vertical movement of said rafters under large roof loadings, in combination:

a sheet metal right-angle strip secured along substantially the entire top edge of said plate so that one leg of the angle extends downwardly and the other leg extends inwardly;

a sheet of ceiling panel having an edge received beneath and in the angle of said strip to engage the downwardly extending leg thereof;

means securing said ceiling panel to the under surfaces of said rafters by a line of fasteners spaced from said angle strip;

a sheet of wall panel having an edge received beneath and in the angle of said angle strip, to supportively engage the lower face of said ceiling panel in said angle strip, and to laterally engage the downwardly extending leg of said angle strip;

and means securing said wall panel to said plate close to said angle strip, the spacing between the angle strip and the first named means being sufficient for the inherent flexibility of the ceiling panel to accomodate normal vertical movement of the truss rafter with respect to the plate.

* * * * *